US007614964B2

(12) United States Patent
Matsunaga

(10) Patent No.: US 7,614,964 B2
(45) Date of Patent: Nov. 10, 2009

(54) GOLF CLUB HEAD

(75) Inventor: Kiyofumi Matsunaga, Kobe (JP)

(73) Assignee: SRI Sports Limited, Kobe (JP)

( * ) Notice: Subject to any disclaimer, the term of this patent is extended or adjusted under 35 U.S.C. 154(b) by 81 days.

(21) Appl. No.: 11/905,942

(22) Filed: Oct. 5, 2007

(65) Prior Publication Data

US 2008/0125246 A1 May 29, 2008

(30) Foreign Application Priority Data

Nov. 29, 2006 (JP) ..... 2006-322318

(51) Int. Cl.
*A63B 53/04* (2006.01)

(52) U.S. Cl. ..... 473/342; 473/346; 473/350

(58) Field of Classification Search ..... 473/324–350, 473/287–292; D21/748–749
See application file for complete search history.

(56) References Cited

U.S. PATENT DOCUMENTS 2,087,685 A * 7/1937 Hackney ..... 473/349
3,814,437 A * 6/1974 Winquist ..... 473/350
D318,703 S * 7/1991 Shearer ..... D21/748
5,377,985 A * 1/1995 Ohnishi ..... 473/324
5,547,427 A * 8/1996 Rigal et al. ..... 473/345
5,595,552 A * 1/1997 Wright et al. ..... 473/332
D400,945 S * 11/1998 Gilbert et al. ..... D21/753
5,971,868 A * 10/1999 Kosmatka ..... 473/349
6,007,432 A * 12/1999 Kosmatka ..... 473/324
D418,887 S * 1/2000 Williams, Jr. ..... D21/749
6,379,262 B1 * 4/2002 Boone ..... 473/324
6,482,107 B1 * 11/2002 Urbanski et al. ..... 473/331
6,746,343 B2 * 6/2004 Yoneyama ..... 473/342
6,800,038 B2 * 10/2004 Willett et al. ..... 473/329
6,800,039 B1 * 10/2004 Tseng ..... 473/329
6,840,872 B2 * 1/2005 Yoneyama ..... 473/346
6,899,638 B2 * 5/2005 Iwata et al. ..... 473/329
6,926,618 B2 * 8/2005 Sanchez et al. ..... 473/329
D553,704 S * 10/2007 Nunez et al. ..... D21/759
7,442,132 B2 * 10/2008 Nishio ..... 473/342
2004/0132544 A1 * 7/2004 Doi ..... 473/345
2006/0111201 A1 5/2006 Nishio et al.
2008/0004129 A1 * 1/2008 Lin et al. ..... 473/332
2008/0248896 A1 * 10/2008 Hirano ..... 473/346

* cited by examiner

*Primary Examiner*—Sebastiano Passaniti
(74) *Attorney, Agent, or Firm*—Birch, Stewart, Kolasch & Birch, LLP

(57) ABSTRACT

A hollow golf club head comprises a face portion having a front face defining a clubface and a rear face facing the hollow. The face portion is provided in the rear face with a central protrusion and a plurality of radial protrusions extending radially from the central protrusion towards the peripheral edge of the face portion. The radial protrusions include at least one variable-width radial protrusion having a variable width increasing towards the peripheral edge from the radially inside. Preferably, a variable-width radial protrusion extending towards the crown portion, and a variable-width radial protrusion extending towards the sole portion of the club head are included.

7 Claims, 12 Drawing Sheets

GOLF CLUB HEAD

BACKGROUND OF THE INVENTION

The present invention relates to a hollow golf club head, more particularly to a face portion having a variable thickness.

In the case of very large sized hollow golf club heads, e.g. wood-type golf club heads and the like, in order not to increase the weight of the club head, it is necessary to decrease the wall thickness of various portions as much as possible. If the thickness of the face portion is decreased, however, as the face portion receives a large impact force when hitting a ball, it is difficult to secure the required strength and durability.

Therefore, a countermeasure usually employed is as shown in FIG. 17, to decrease the thickness of an annular part surrounding the central part of the face portion in order not to decrease the strength of the central part.

In U.S. Patent application publication No. 2006-111201-A1, the rear face (a) of the face portion is as shown in FIG. 19, provided with relatively narrow, constant-width ribs (b). The ribs (b) extend radially from the face center so as to form reduced-thickness parts (c) between the ribs (b).

On the other hand, when the face portion hits a ball, large stress and large strain occur in the vicinity of the peripheral edge of the face portion. In the above two cases, as apparent from FIGS. 17 and 19, the reduced-thickness part, namely, thin part is formed along large portion of the peripheral edge of the face portion. Therefore, in view of the strength and durability, there is room for improvement. If the amount of decrease in the thickness of the reduced-thickness part is lessened, defeating the original purpose, then the deflection of the face portion at impact is decreased, therefore the rebound performance becomes liable to deteriorate.

SUMMARY OF THE INVENTION

It is therefore, an object of the present invention to provide a hollow golf club head, in which the durability can be improved without deteriorating the rebound performance.

According to the present invention, a hollow golf club head comprises a face portion having a front face defining a clubface and a rear face facing the hollow, the face portion provided in the rear face with a central protrusion and a plurality of radial protrusions extending radially from the central protrusion towards the peripheral edge of the face portion, wherein the radial protrusions include at least one variable-width radial protrusion having a variable width increasing towards the peripheral edge from the radially inside.

Since the face portion has a shape being long sideways, it is preferable that a variable-width radial protrusion extending towards the crown portion, and a variable-width radial protrusion extending towards the sole portion of the club head are included. Further, it is preferable that a vertical line passing through the sweet spot of the clubface is included within the widths of the above-mentioned variable-width radial protrusions extending towards the crown portion and sole portion.

In this specification, the dimensions, positions and directions refer to those under the standard state of the club head unless otherwise noted.

The standard state of the club head is such that the club head is set on a horizontal plane so that the axis of the clubshaft (or the shaft inserting hole of the hosel) is inclined at the lie angle while keeping the axis on a vertical plane, and the clubface forms its loft angle with respect to the horizontal plane.

The sweet spot SS is the point of intersection between the clubface and a straight line drawn normally to the clubface passing the center of gravity of the head.

DESCRIPTION OF THE PREFERRED EMBODIMENTS

Figure 1:
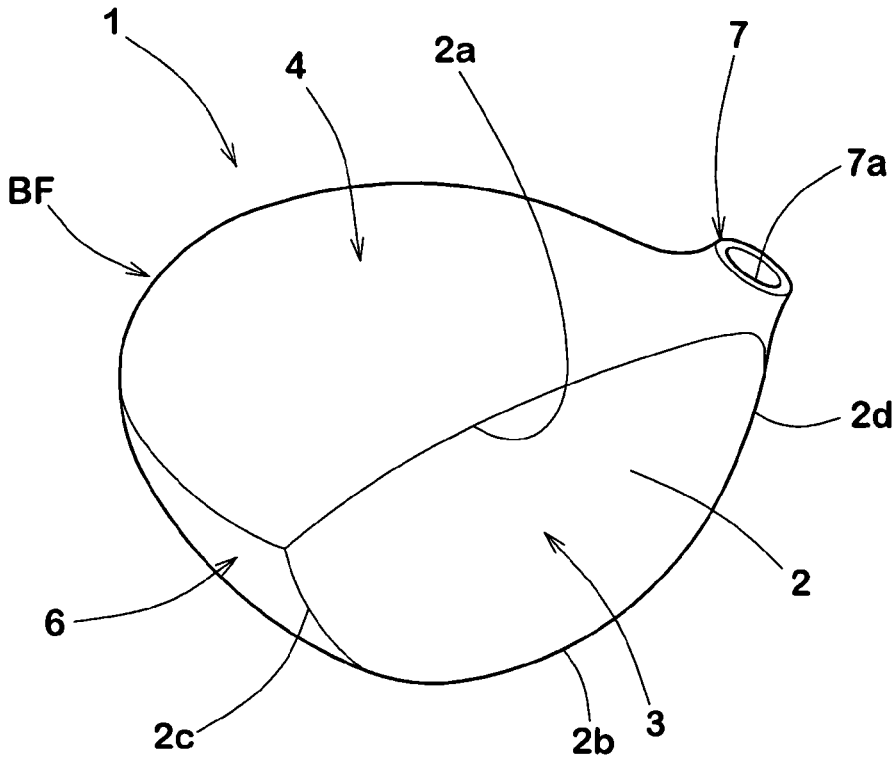
FIG. 1 is a perspective view of a wood-type golf club head according to the present invention.
Figure 2:
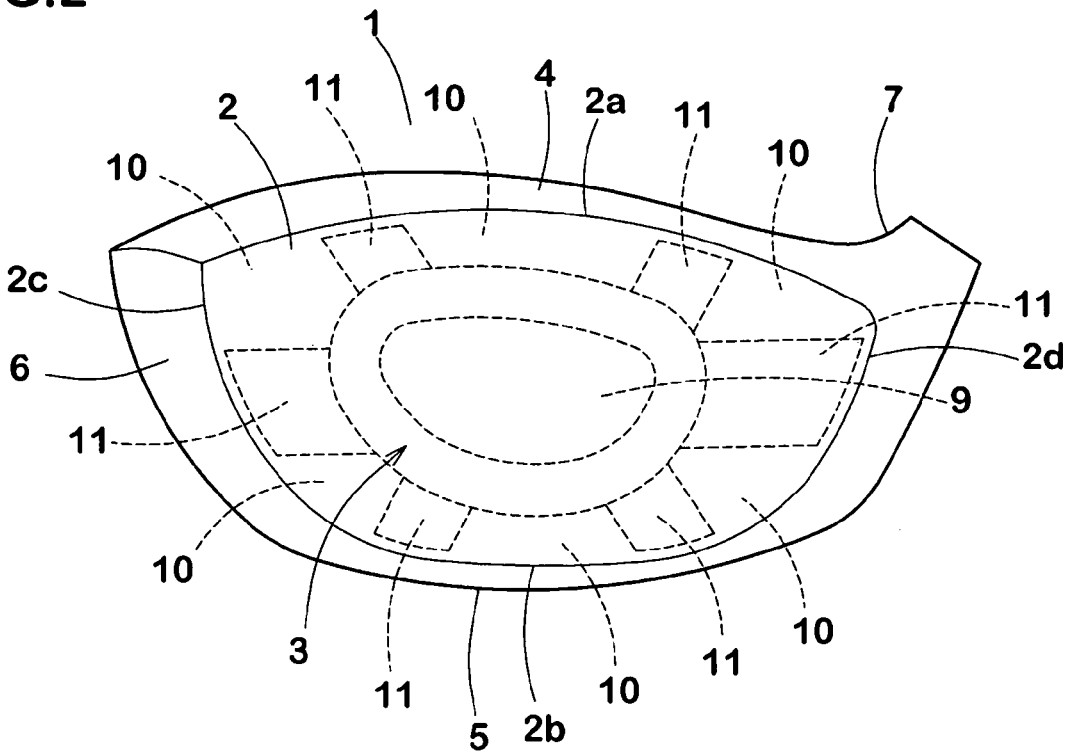
FIG. 2 is a front view thereof wherein a patterned protrusion on the rear face of the face portion is indicated by dotted line.

Embodiments of the present invention will now be described in detail in conjunction with accompanying drawings.

In the drawings, golf club head 1 according to the present invention is a hollow head for a wood-type golf club such as driver (#1) or fairway wood, and the head 1 comprises: a face portion 3 whose front face defines a clubface 2 for striking a ball; a crown portion 4 intersecting the clubface 2 at the upper edge 2*a* thereof; a sole portion 5 intersecting the clubface 2 at the lower edge 2*b* thereof; a side portion 6 between the crown portion 4 and sole portion 5 which extends from a toe-side edge 2*c* to a heel-side edge 2*d* of the clubface 2 through the back face BF of the club head; and a hosel portion 7 at the heel side end of the crown to be attached to an end of a club shaft (not shown) inserted into the shaft inserting hole 7*a*. Thus, the club head 1 is provided with a hollow (i) and a shell structure with the thin wall.

In this embodiment, the hollow (i) is void, but a filler, e.g. foamed plastic and the like can be disposed therein.

In the case of a wood-type club head for a driver (#1), it is preferable that the head volume is set in a range of not less than 380 cc, more preferably not less than 400 cc, still more preferably not less than 420 cc in order to increase the moment of inertia and the depth of the center of gravity. However, to prevent an excessive increase in the club head weight and deteriorations of swing balance and durability and further in view of golf rules or regulations, the head volume is preferably set in a range of not more than 470 cc, more preferably not more than 460 cc.

The mass of the club head 1 is preferably set in a range of not less than 180 grams, more preferably not less than 185 grams in view of the strength and swing balance, but not more than 220 grams, more preferably not more than 215 grams in view of the directionality and traveling distance of the ball.

Figure 3:
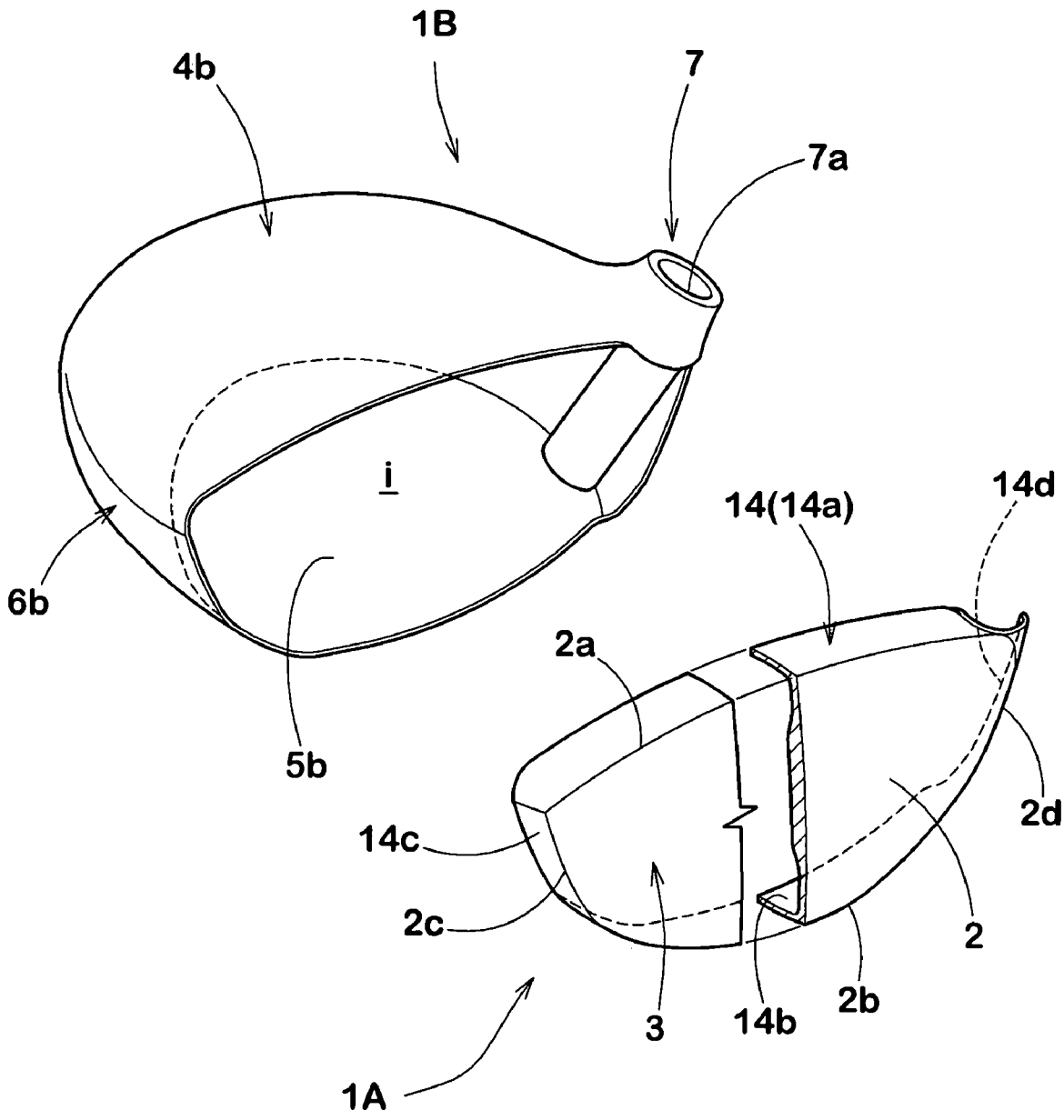
FIG. 3 and FIG. 4 are exploded perspective views each showing a two-piece structure which can be incorporated into the club head according to the present invention.
Figure 4:
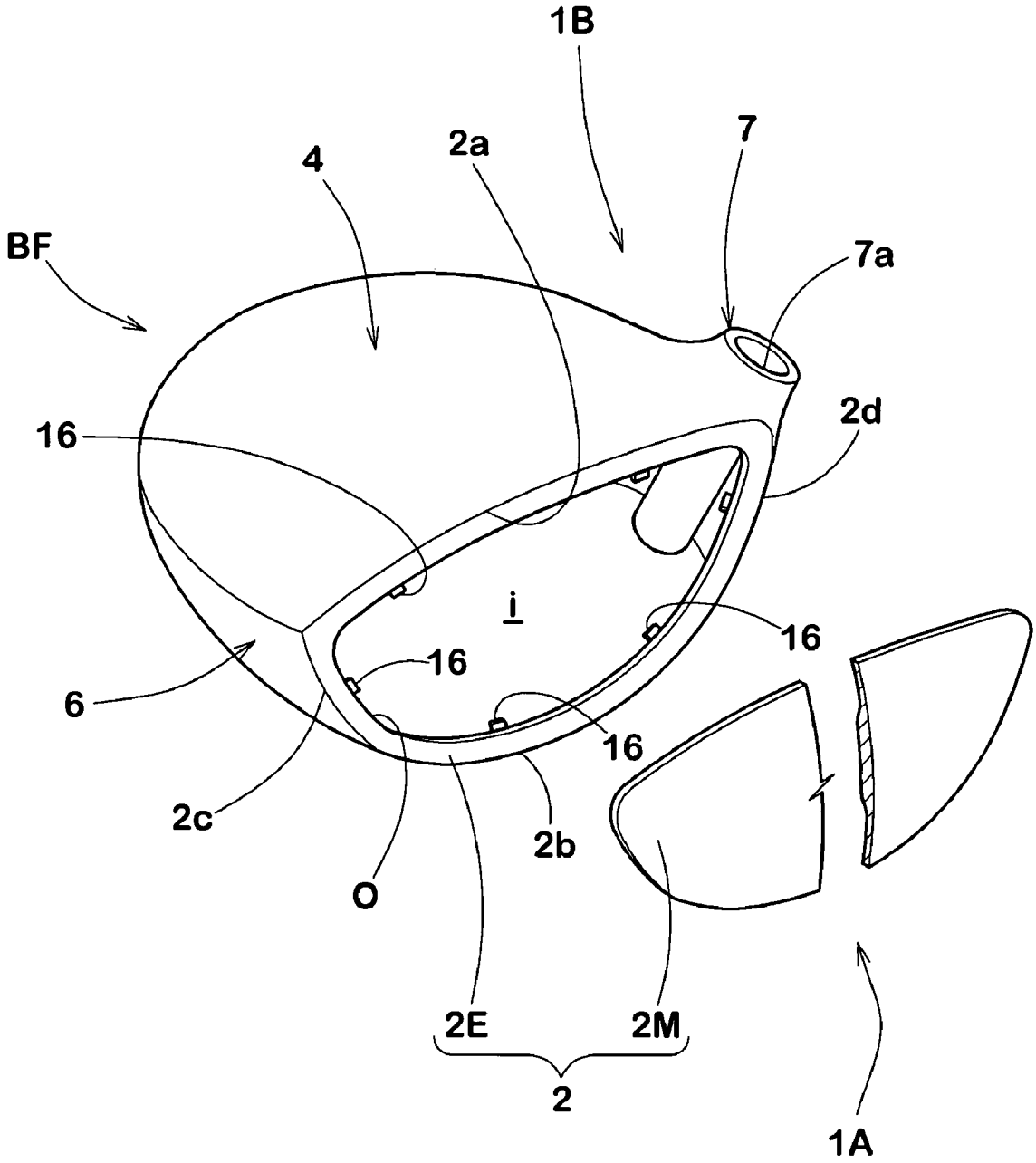

The club head 1 can be a two- or three- or four-piece structure. This embodiment has a two-piece structure comprising, as shown in FIG. 3 or 4, a main shell 1B made of one or more kinds of metal materials, and a face plate 1A made of a metal material. The face plate 1A is attached to the front of the main shell 1B so as to cover the opening O of the main shell 1B.

In the example shown in FIG. 3, the face plate 1A forms the entirety of the face portion 3, and the backwardly extending turnbacks 14*a*, 14*b*, 14*c* and 14*d* are formed along the edges 2*a*, 2*b*, 2*c* and 2*d* of the clubface 2. As the turnbacks 14*a*, 14*b*, 14*c* and 14*d* form the front zones of the respective portions 3, 4 and 5, the main shell 1B forms the remainder of the club head. Namely, the main shell 1B comprises: a major posterior part 4*b* of the crown portion 4; a major posterior part 5*b* of the sole portion 5; a major posterior part 6*b* of the side portion 6; and the hosel portion 7.

In the example shown in FIG. 4, the face plate 1A is a metal plate which is slightly smaller than the clubface 2 and forms a major part 2M of the face portion 3. The turnback is not formed. The main shell 1B comprises the crown portion 4, sole portion 5, side portion 6 and hosel portion 7, and further a peripheral part 2E of the face portion 3 between the peripheral edges 2*a*-2*d* of the clubface 2 and the edge of the opening O into which the face plate 1A is fitted. In this example, the clubface 2 is defined by the face plate 1A and the peripheral part 2E.

The face plate 1A and main shell 1B are preferably made of metal materials having large specific tensile strength. Specifically, stainless steels, maraging steels, pure titanium, titanium alloys, magnesium alloys, aluminum base alloys can be preferably used. As to the titanium alloys, Ti-6Al-4V, Ti-15V-3Cr-3Al-3Sn, Ti-15Mo-5Zr-3Al, Ti-13V-11Cr-3Al or the like can be preferably used.

The face plate 1A and the main shell 1B can be made out of the same metal materials, but it is also possible that these are made out of different metal materials. In any case, it is desirable that the main shell 1B is a single piece structure formed by for example, casting. Incidentally, a fiber reinforced resin may be used to form a part of the head.

According to the present invention, the face portion 3 is provided on the rear face 8 with a patterned protrusion.

The patterned protrusion includes: a central protrusion 9; at least four rib-like radial protrusions 10 extending radially from the central protrusion 9; and an annular peripheral protrusion 15.

The peripheral protrusion 15 is optional, but desirably provided. The peripheral protrusion 15 extends continuously along the peripheral edge of the face portion 3 to improve the strength and durability in the vicinity of the peripheral edge. The peripheral protrusion 15 has a thickness (te) substantially same as or larger than the maximum thickness (tr) of the radial protrusions 10. Preferably, the ratio (tr/te) is in a range of not less than 0.5, preferably not less than 0.9, but not more than 1.1. Preferably, the width Wg of the annular peripheral protrusion 15 is set in the range of 2 to 5 mm.

In the case of the example shown in FIG. 4, the peripheral protrusion 15 can be formed by the peripheral part 2E of the face portion 3.

The central protrusion 9 comprises: a main part 9*a* including the central point Z and having a substantial constant thickness (tc); and a thickness-transitional part 9*b* surrounding the main part 9*a* and having a thickness gradually decreasing towards the peripheral edge of the face portion 3.

Here, the central point Z means a point on the rear face 8 corresponding to the sweet spot SS on the clubface 2.

The main part 9*a* has a round shape long in the toe-and-heel direction such as ellipses or ovals. Preferably, the centroid thereof substantially coincides with the central point Z.

The thickness (tc) of the main part 9*a* is the maximum thickness of the face portion 3. The thickness (tc) is set in a range of not less than 2.5 mm, preferably not less than 2.8 mm for the durability of the face portion 3, but not more than 4.0 mm, preferably not more than 3.5 mm in view of the rebound performance and the directionality of the struck ball.

The area S1 of the main part 9*a* is not less than 10%, preferably not less than 15% of the overall area S of the rear face 8 in view of the durability of the face portion, but not more than 40%, preferably not more than 30%, more preferably not more than 20% of the overall area S in view of the rebound performance and the directionality of the struck ball.

For the same reasons as above, the area of the central protrusion 9 which is the sum total (S1+S2) of the area S1 of the main part 9*a* and the area S2 of the thickness-transitional part 9*b* is not less than 20%, preferably not less than 30%, more preferably not less than 40%, but not more than 70%, preferably not more than 60%, more preferably not more than 50% of the overall area S of the rear face 8.

In practice, instead of using the actual surface areas S1 and S2, the areas projected on the clubface 2 can be used because the differences are negligible. Correspondingly, the overall area of the clubface 2 can be used instead of the overall area S of the rear face 8.

The thickness of the thickness-transitional part 9*b* decreases from the main part 9*a* (thickness tc) towards the peripheral edge of the face portion 3.

Figure 6:
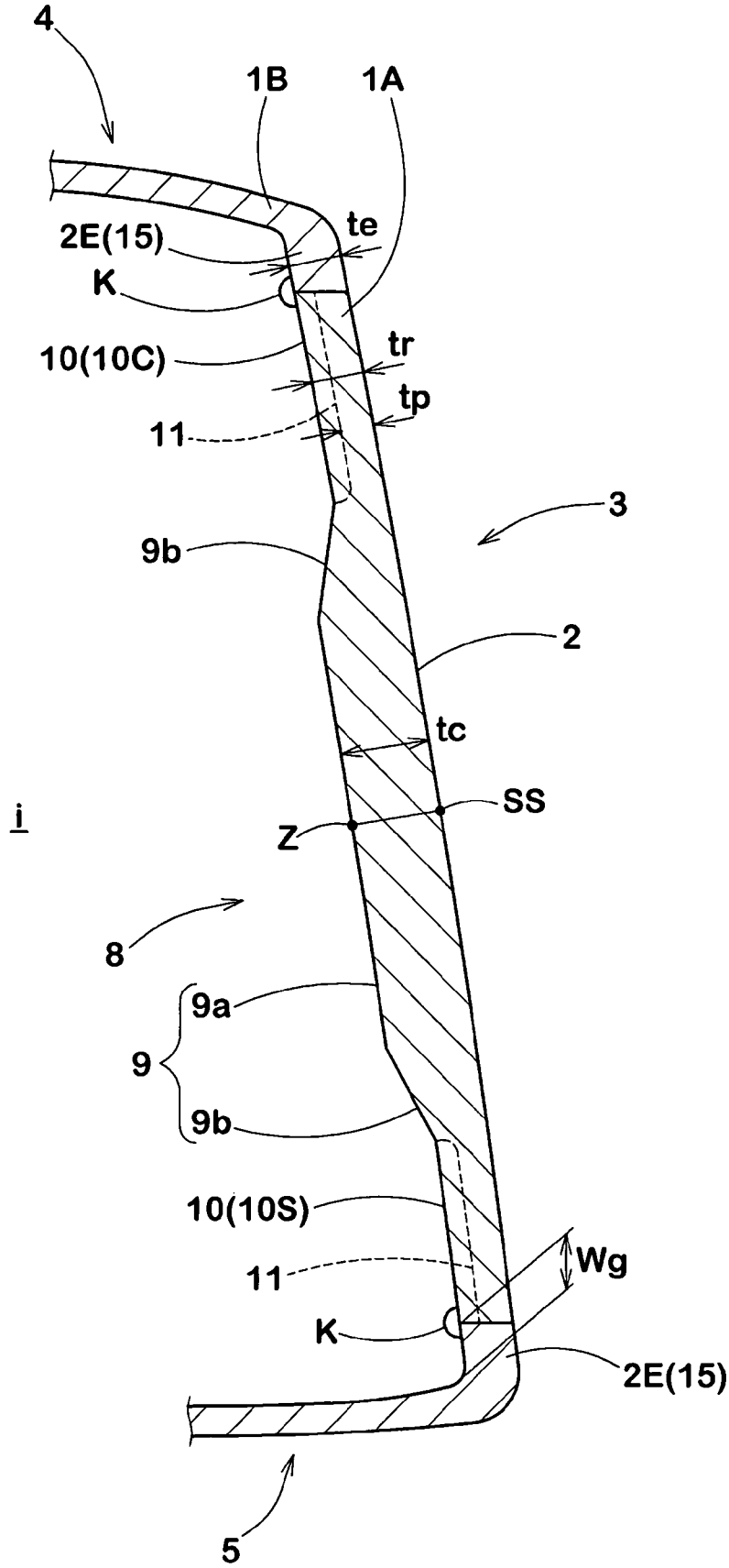
FIG. 6 is an enlarged cross sectional view of the face portion taken along line A-A in FIG. 5.
Figure 7:
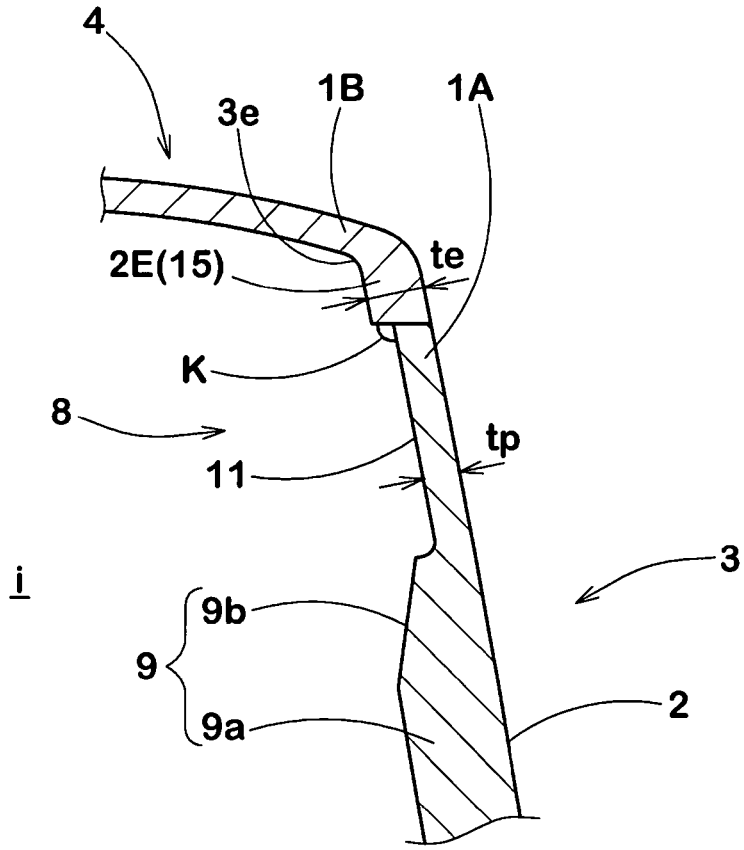
FIG. 7 is an enlarged cross sectional view taken along line B-B in FIG. 5.

In this embodiment, the thickness-transitional part 9*b* merges into the radial protrusions 10 as shown in FIG. 6 whereas the thickness-transitional part 9*b* is connected with the resultant reduced-thickness parts 11 through a step as shown in FIG. 7. It is of course possible to connect the thickness-transitional part 9*b* with the reduced-thickness parts 11 without step.

In this embodiment, the thickness-transitional part 9*b* is provided. But, the central protrusion 9 may be made up of the main part 9*a* only. In such a case, the main part 9*a* can be the same thickness as the radial protrusions 10.

The radial protrusions 10 includes a crown-side radial protrusion 10C, a sole-side radial protrusion 105, a toe-side radial protrusion 10T, and a heel-side radial protrusion 10H.

The number of the radial protrusions 10 is more than three, preferably more than four, more preferably more than five, but not more than ten, preferably not more than eight. In this embodiment, the number of the radial protrusions 10 is six.

Figure 8:
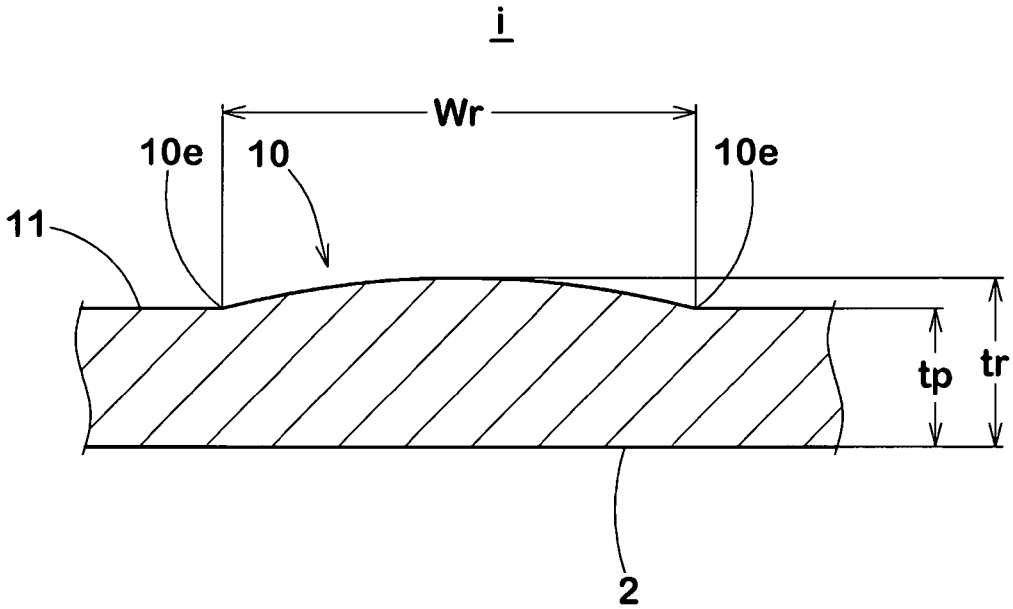
FIG. 8 is an enlarged cross sectional view taken along line C-C in FIG. 5.

In the cross section perpendicular to the radial extending direction of the radial protrusion 10, the profile of the radial protrusion 10 in this example is, as shown in FIG. 8, an arced line which swells towards the hollow (i) so that a maximum thickness (tr) occurs in the middle in the widthwise direction of the radial protrusion 10. However, it is not always necessary that the profile is an arced line. For example, the cross sectional shape of the radial protrusion 10 can be a semicircle, trapezoid, triangle and the like.

The above-mentioned maximum thickness (tr) is smaller than the maximum thickness (tc) of the central protrusion 9. (tr<tc). The maximum thickness (tr) is set in a range of not less than 1.6 mm, preferably not less than 2.0 mm, but not more than 4.0 mm, preferably not more than 3.0 mm. The maximum thickness (tr) is substantially constant along the entire length of the radial protrusion 10.

The reduced-thickness parts 11 between the radial protrusions 10 each extend from the central protrusion 9 towards the peripheral edge of the face portion (to the peripheral protrusion 15 in this example).

The reduced-thickness parts 11 each have a minimum thickness (tp) in a range of not less than 1.6 mm, preferably not less than 2.0 mm, but not more than 3.0 mm, preferably not more than 2.8 mm. If the thickness (tp) is less than 1.6 mm, it becomes difficult to provide a necessary durability for the face portion. If the thickness (tp) is more than 3.0 mm, a deterioration of the rebound performance and undesirable shallow center of gravity become unavoidable.

The ratio (tp/tc) of the minimum thickness (tp) of the reduced-thickness part 11 to the maximum thickness (tc) of the central protrusion 9 is set in a range of not less than 0.40, preferably not less than 0.50, more preferably not less than 0.60, but not more than 0.90, preferably not more than 0.80, more preferably not more than 0.75. If the ratio (tp/tc) is less than 0.40, the stress at impact becomes liable to concentrate in the reduced-thickness part 11. If the ratio (tp/tc) is more than 0.90, there is a possibility of increasing the weight of the face portion and deteriorating the rebound performance.

The ratio (tp/tr) of the minimum thickness (tp) of the reduced-thickness part 11 to the maximum thickness (tr) of the radial protrusion 10 is set in a range of not less than 0.60, preferably not less than 0.70, more preferably not less than 0.80, but not more than 0.98, preferably not more than 0.95, more preferably not more than 0.92. If the ratio (tp/tr) is less than 0.60, the stress at impact becomes liable to concentrate in the reduced-thickness part 11. If the ratio (tp/tr) is more than 0.98, there is a possibility of increasing the weight of the face portion and deteriorating the rebound performance.

The width Wu of the reduced-thickness part 11 is set in a range of not less than 5.0 mm, preferably not less than 8.0 mm, but not more than 30.0 mm, preferably not more than 15.0 mm. If the width Wu is less than 5.0 mm, the stress at impact is very liable to concentrate in the reduced-thickness part 11 and there is a possibility of deteriorating the durability. If the width Wu is more than 30.0 mm, the vicinity of the peripheral edge of the face portion 3 adjacent to the reduced-thickness part 11 decreases in the strength and the durability is decreased.

Between the adjacent variable-width radial protrusions 10*a*, a constant-width reduced-thickness part 11 is formed. In other words, two opposite side edges 10*e* of the adjacent two variable-width radial protrusions 10*a* are substantially parallel with each other.

The reduced-thickness parts 11 can include a variable-width reduced-thickness part having a width decreasing or increasing towards the peripheral edge. It is however, desirable that at least one of, preferably all of, the reduced-thickness parts 11 is a constant-width reduced-thickness part having a substantially constant width Wu along its radial extending direction. Such reduced-thickness parts 11 allow optimum deflection of the face portion 3 at impact and prevent the rebound performance from deteriorating. Further, the weight of the face portion 3 can be reduced, without deteriorating the durability.

Figure 5:
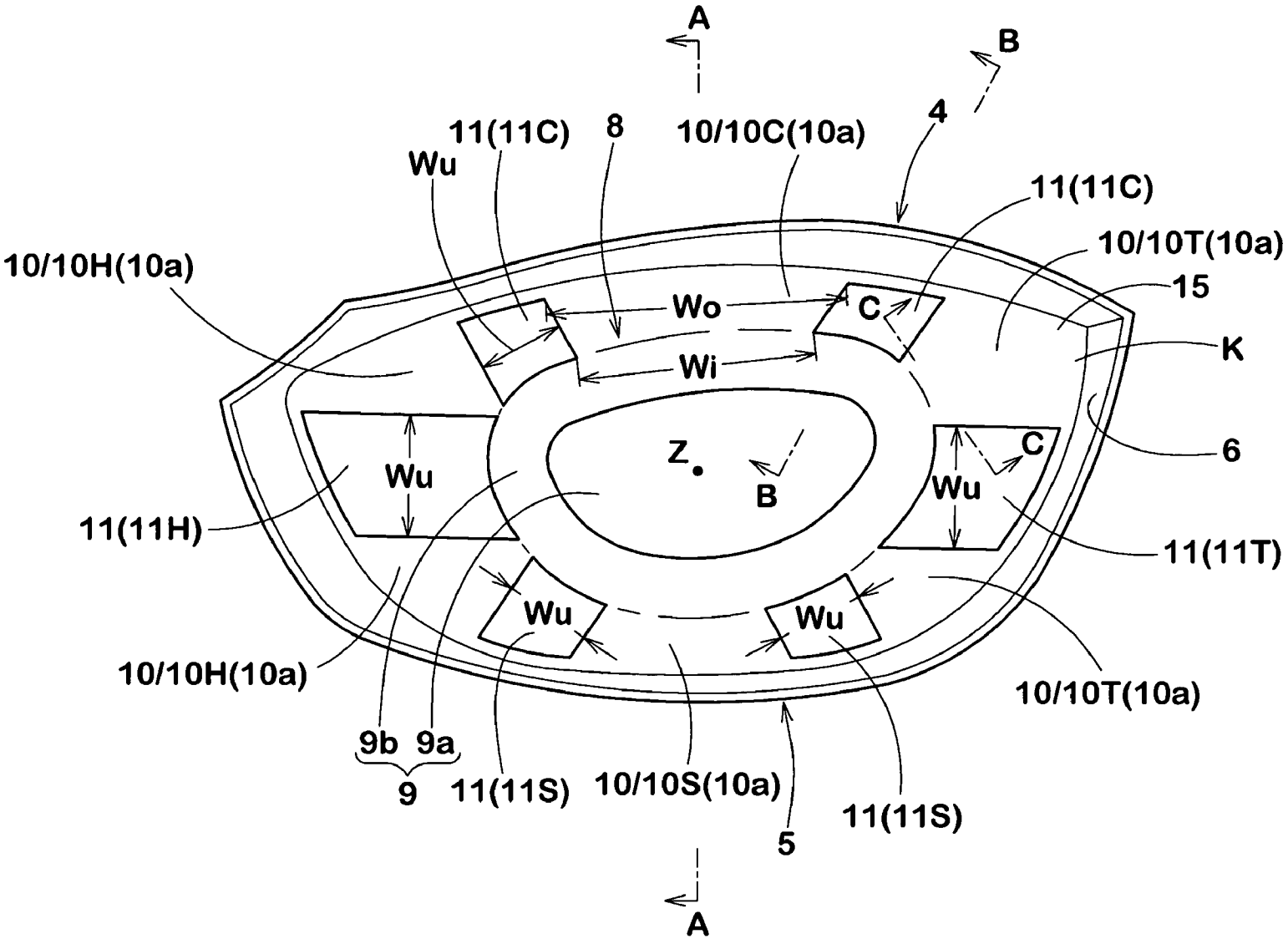
FIG. 5 is a rear view of the face portion showing the patterned protrusion.

In this embodiment, as shown in FIG. 5, the reduced-thickness parts 11 include: at least one crown-side reduced-thickness part 11C extending towards the crown portion 4; at least one sole-side reduced-thickness part 11S extending towards the sole portion 5; at least one toe-side reduced-thickness part 11T extending towards the toe; and at least one heel-side reduced-thickness part 11H extending towards the heel.

In order to improve the rebound performance without deteriorating the durability, it is preferred that the toe-side reduced-thickness part 11T and heel-side reduced-thickness part 11H are larger in width than the crown-side reduced-thickness part 11C and sole-side reduced-thickness part 11S.

According to the present invention, at least one of the radial protrusions 10 has a width increasing from the radially inside to the radially outside (hereinafter, the "variable-width radial protrusion 10*a*"). In this embodiment, all the radial protrusions 10 are the variable-width radial protrusions 10*a*.

Figure 9:
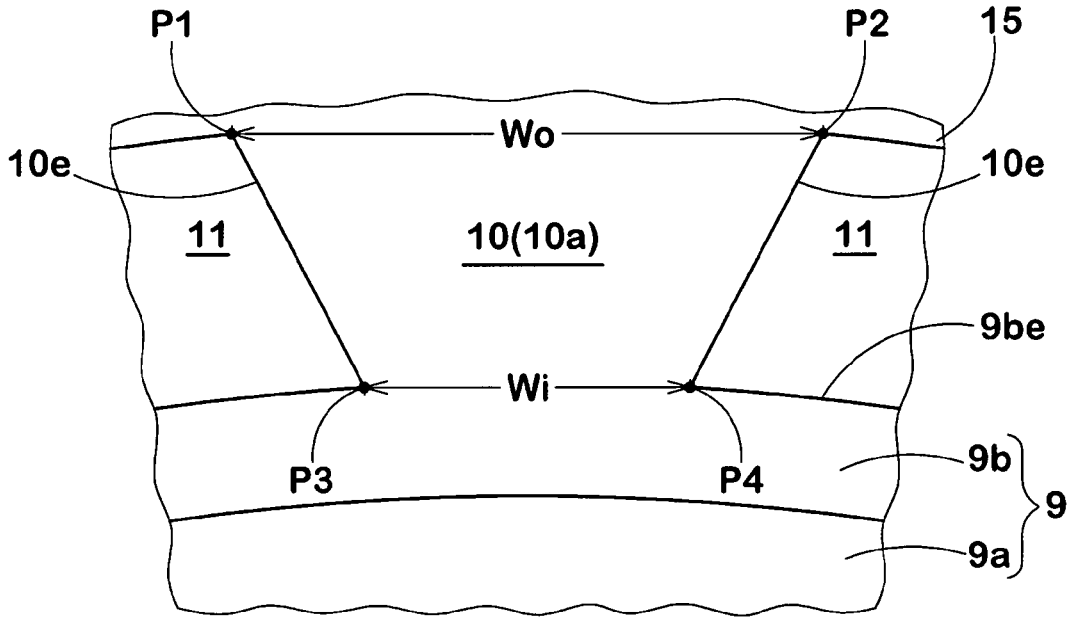
FIG. 9 is a schematic rear view of a variable-width radial protrusion.

The variable-width radial protrusion 10*a* has a pair of nonparallel side edges 10*e*, and the width is gradually increased as shown in FIG. 9.

Figure 10:
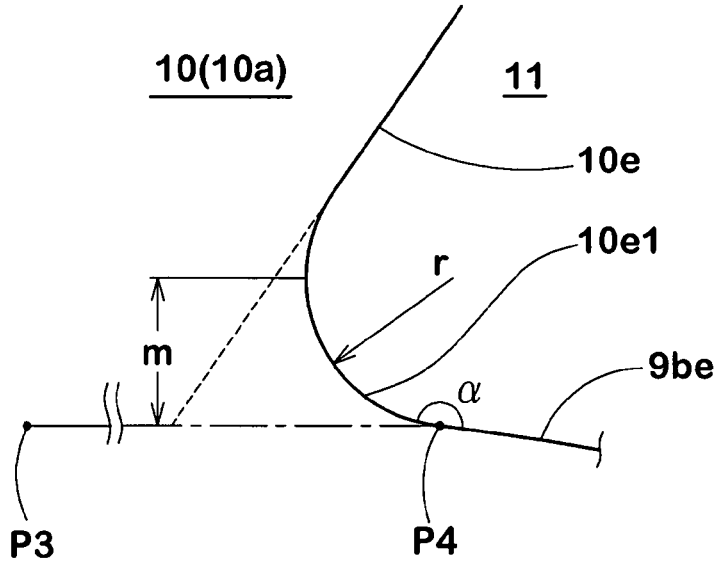
FIG. 10 is an enlarged partial rear view thereof showing a rounded corner.

It is preferable that the acute-angle corner between the side edge 10*e* and the edge 9*be* of the central protrusion 9 is rounded as shown in FIG. 10 in order to avoid stress concentration.

Such rounding is desirable not only in the case of the variable-width radial protrusion 10*a* but also in the case of constant-width radial protrusion 10. Therefore, in this embodiment, all the acute-angle corners are rounded although not specifically illustrated in the drawings for convenience sake.

When the corners are not rounded, the minimum width Wmin of the variable-width radial protrusion 10*a* occurs at the radially inner end of the radial protrusion.

When the corners are rounded, the minimum width Wmin of the variable-width radial protrusion 10*a* occurs slightly radially outside the radially inner end of the radial protrusion. If the minimum width occurs far from the inner end, the effect of the variable-width decreases. Therefore, the distance (m) between the inner end and the position where the minimum width Wmin occurs is set in a range of not more than 3 mm, preferably not more than 2 mm.

Figure 11:
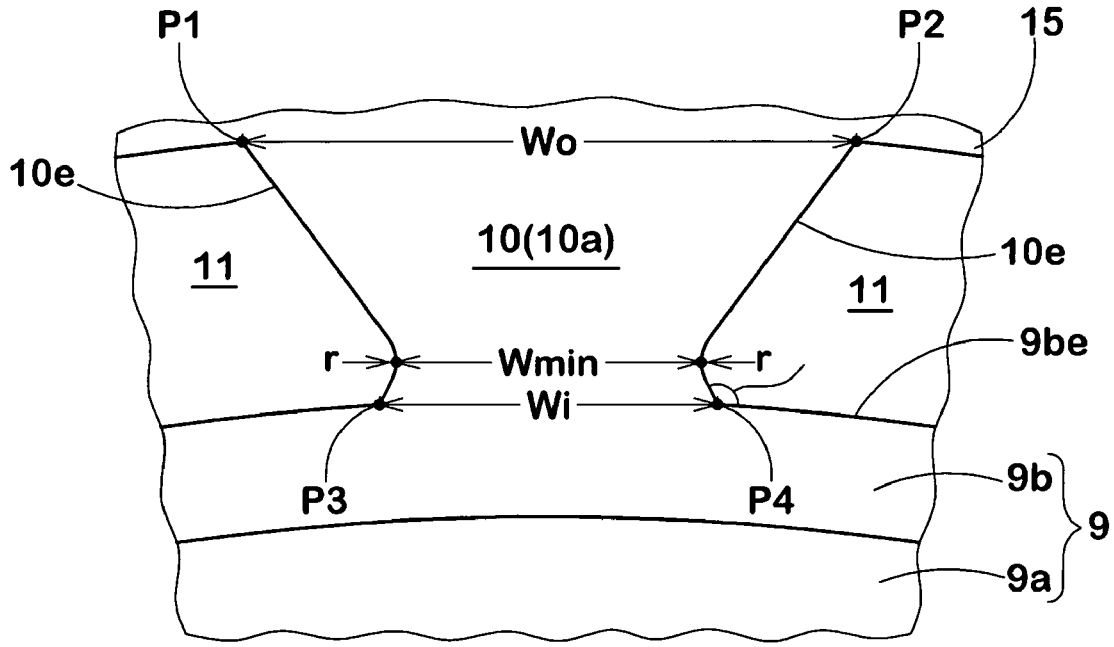
FIG. 11 is a schematic rear view of another example of the variable-width radial protrusion.
Figure 12:
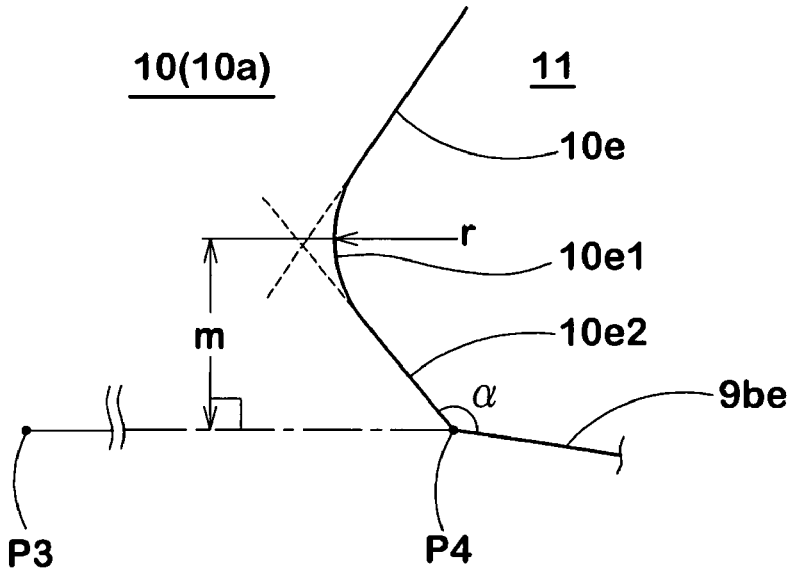
FIG. 12 is an enlarged partial rear view thereof.

The rounded corner is defined by only a circular arc 10*e*1 having a radius (r) as shown in FIG. 10. However, as far as the distance (m) is relatively small and the intersecting angle alpha is an obtuse angle, as shown in FIGS. 11 and 12, the side edge 10*e* may include a part 10*e*1 defined by a circular arc of a radius (r) and a part 10*e*2 defined by a straight line intersecting the edge 9*be* at an angle alpha.

If the inside width Wi at the radially inner end of the variable-width radial protrusion 10*a* or the minimum width Wmin is less than 5 mm, then a stress concentration is very liable to occur in the minimum width portion or the junction between the radial protrusion 10 and the central protrusion 9, and there is a possibility of deteriorating the durability. Therefore, the inside width Wi and the minimum width Wmin are set in a range of not less than 5 mm, preferably not less than 8 mm, but preferably not more than 50 mm, more preferably not more than 40 mm, still more preferably not more than 32 mm.

By the variable-width radial protrusions 10*a*, the face portion 3 is increased in the strength in the vicinity of the peripheral edge thereof where a large stress occurs at impact, thus the durability can be improved. If the maximum width of the variable-width radial protrusion 10*a* is too small in comparison with the minimum width, it is difficult to reinforce the vicinity of the peripheral edge to improve the durability of the face portion. If the maximum width is increased, the effect of improving the durability hits the peak, and there is a possibility of increasing the weight of the face portion 3 and deteriorating the rebound performance.

Therefore, the maximum width or the outside width Wo of the variable-width radial protrusion 10*a* at the radially outer end is set in a range of not less than 1.1 times, preferably not less than 1.2 times, more preferably not less than 1.4 times, but not more than 5.0 times, preferably not more than 4.0 times, more preferably not more than 3.0 times the minimum width Wmin or the inside width Wi.

Here, the outside width Wo can be defined by the distance between the radially outer ends P1 and P2 of the side edges 10*e*. The inside width Wi can be defined by the distance between the radially inner ends P3 and P4 of the side edges 10*e*.

In this embodiment, all the radial protrusions 10 are the variable-width radial protrusions 10*a*. But, it is of course possible to use the variable-width radial protrusions 10*a* in combination with a radial protrusion 10 having a constant-width. For example, the variable-width radial protrusions 10*a* can be disposed in only positions where higher strength or higher durability is required. More specifically, it is possible that the crown-side radial protrusions 10*c* and/or the sole-side radial protrusions 10S are formed as a variable-width radial protrusion 10*a*, and the rests are formed as a constant-width radial protrusion.

The increasing of the width of the variable-width radial protrusion 10*a* can be stepwise or continuous as far as the increasing is gradual. Accordingly, it is especially preferable that the side edges 10*e* are linear or smoothly curved.

As to the manufacturing of the club head, the main shell 1B can be formed by casting a metal material. When casting the main shell 1B as shown in FIG. 4, a plurality of small projections 16 for the purpose of supporting and positioning the face plate 1A can be formed around the opening O into which the face plate 1A is fitted.

The face plate 1A can be formed by cutting a rolled metal sheet into a specific shape by the use of dies, laser or the like, and then shaping the cutout metal piece into a final shape by means of mold press.

In order to form the patterned protrusions on the rear face 8 of the face plate 1A, computer numerical control milling can be preferably used for the high precision.

The face plate 1A can be fixed to the main shell 1B by welding. For that purpose, TIG welding, laser welding, plasma welding or the like can be used.

Even if a weld bead K is formed during welding, in the case of the example shown in FIG. 3, as the weld bead K is not formed in the face portion, there is no influence on the effect of the patterned protrusion. In the case of the example shown in FIG. 4, the weld bead K is formed along the relatively thick peripheral protrusion 15, influence of the weld bead K can be neglected.

Comparison Tests

Wood-type golf club heads (volume 455 cc, clubface area 36.5 sq.mm) were made and tested for the durability and the rebound performance.

All the club heads had same structures as shown in FIG. 4 except for the protrusions on the rear face of which specifications are shown in Table 1.

The main shell 1B was a casting of a titanium alloy Ti-6Al-4V formed by lost-wax precision casting. The peripheral part 2E of the face portion forming the annular peripheral protrusion 15 had a width of 2 to 3 mm, and a thickness te of 2.65 mm. The face plate 1A was made of a titanium alloy Ti-6Al-4V, and formed by dies cutting the rolled titanium alloy. The face plate 1A was welded to the main shell 1B. The patterned protrusions were formed by computer numerical control milling. The patterns are shown in FIGS. 13-18.

Figure 13:
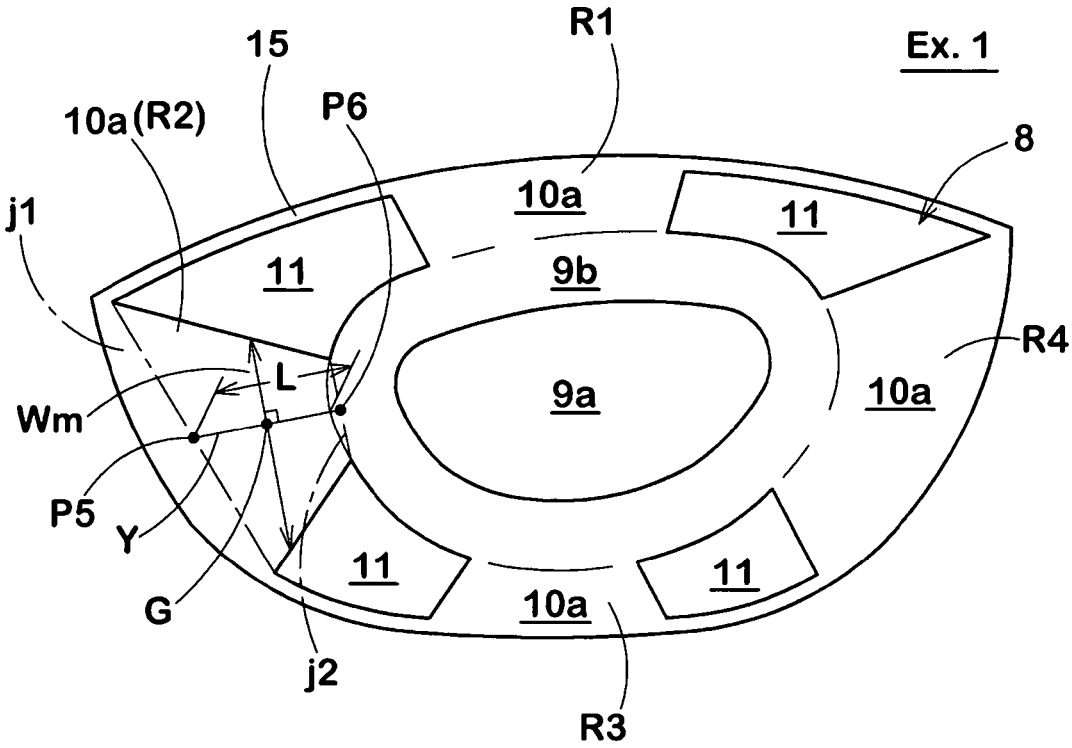
FIGS. 13-18 are rear views of face portions of club heads used in the undermentioned comparison tests.

Ex. 1: As shown in FIG. 13, the rear face was provided with four variable-width radial protrusions. Two sole-side reduced-thickness parts had substantially constant widths.

Figure 14:
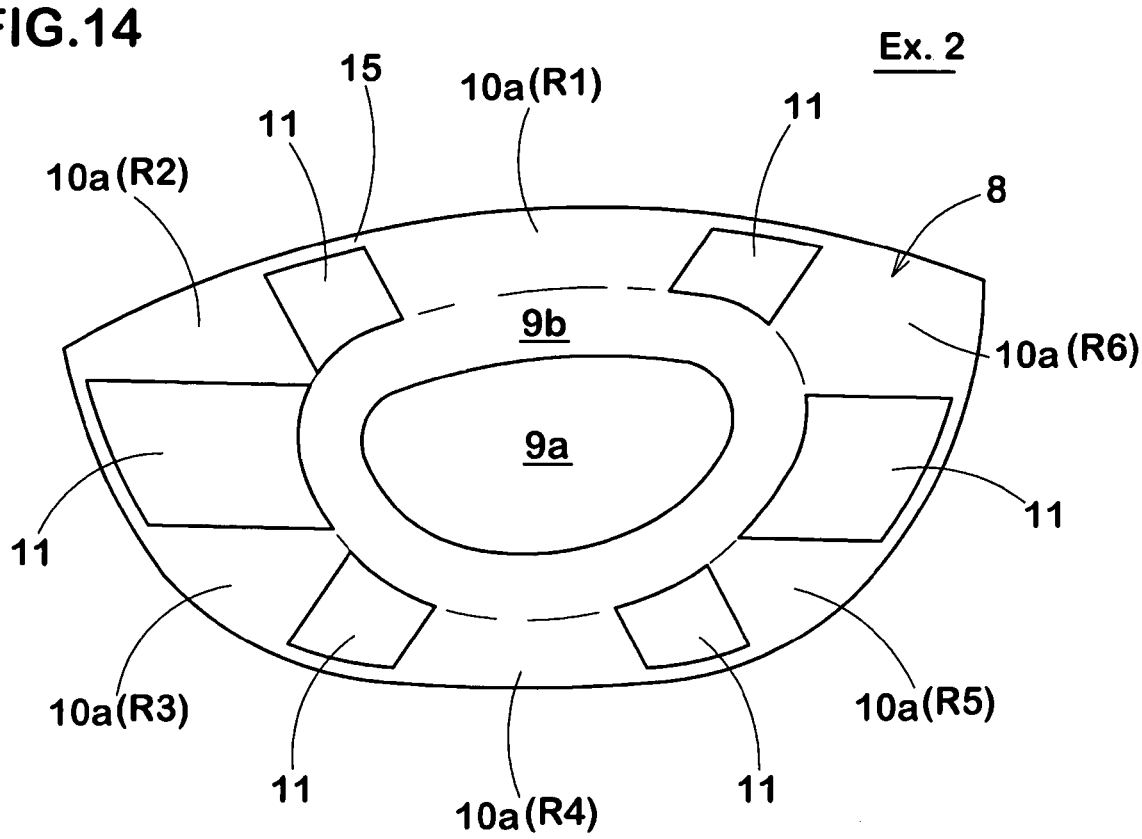

Ex. 2: As shown in FIG. 14, the rear face was provided with six variable-width radial protrusions. All the six reduced-thickness parts had substantially constant widths.

Figure 15:
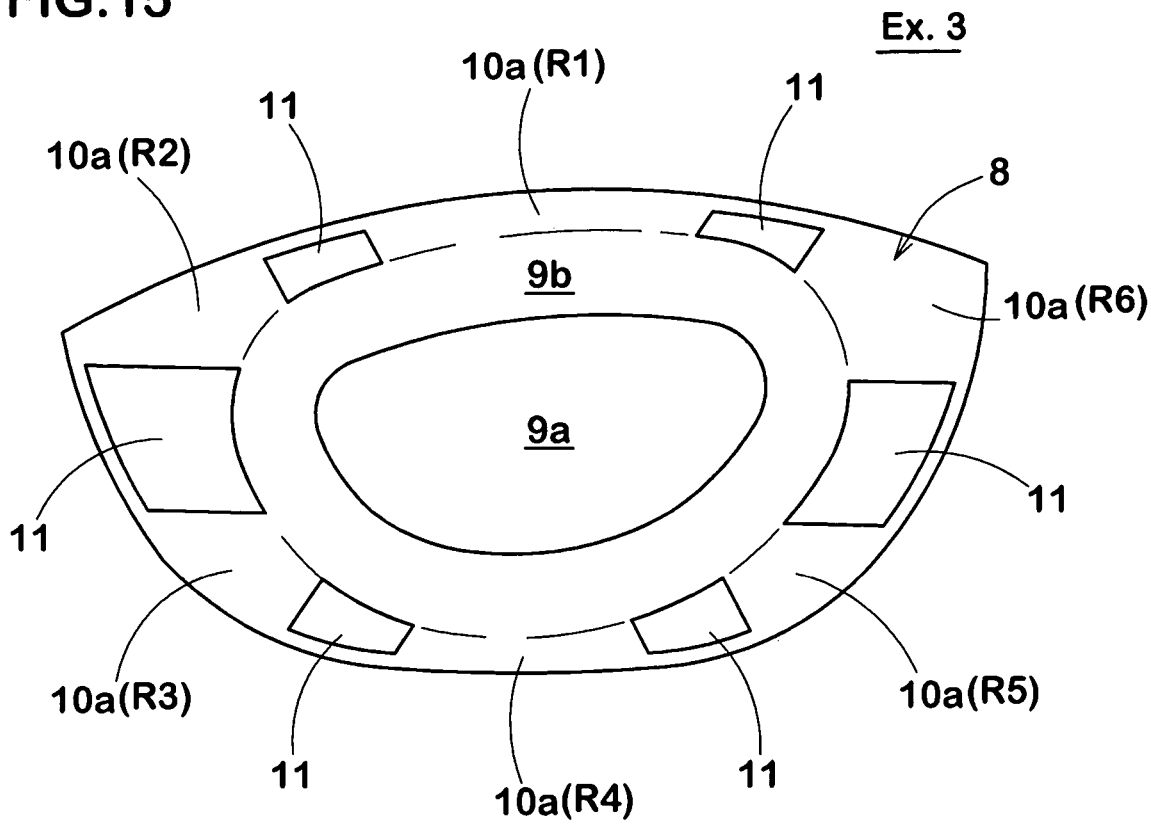

Ex. 3: As shown in FIG. 15, this example was a modification of Ex. 2 wherein the central protrusion was enlarged.

Figure 16:
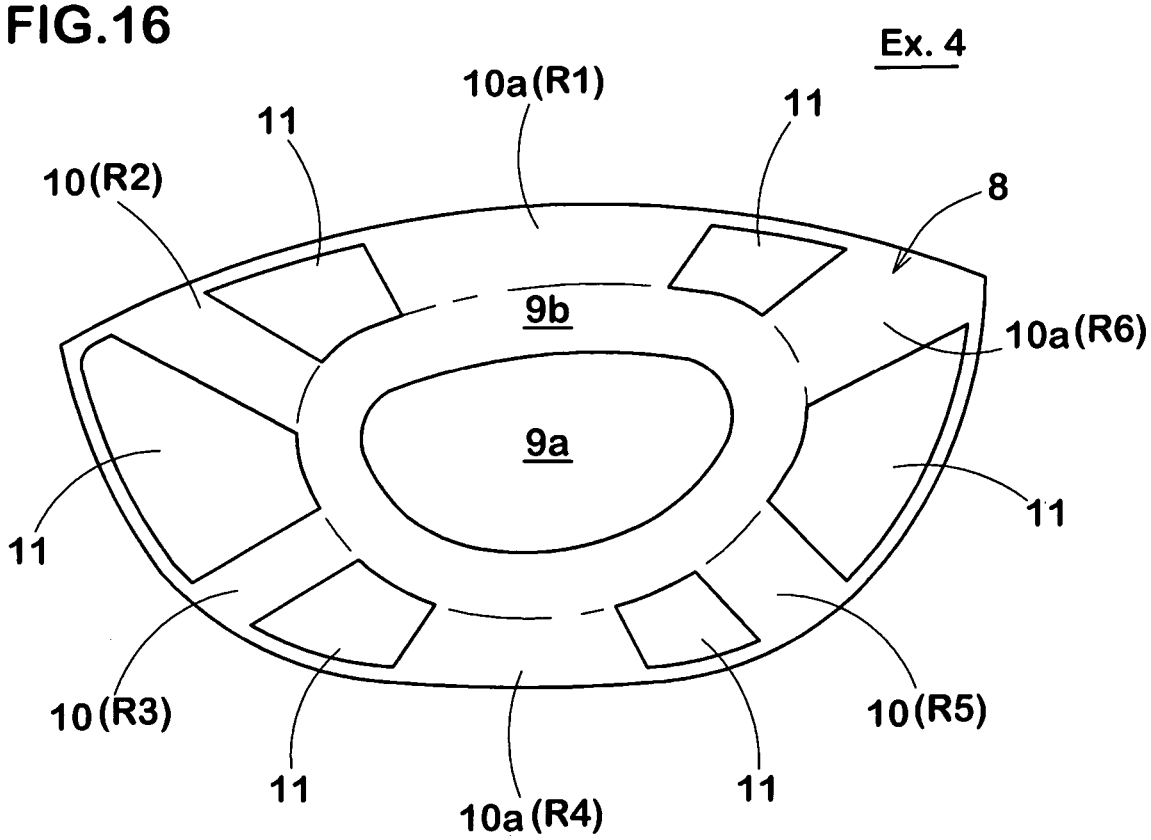

Ex. 4: As shown in FIG. 16, this example was a modification of Ex. 2 wherein the radial protrusions R2, R3, R5 and R6 were replaced by constant-width radial protrusions.

Figure 17:
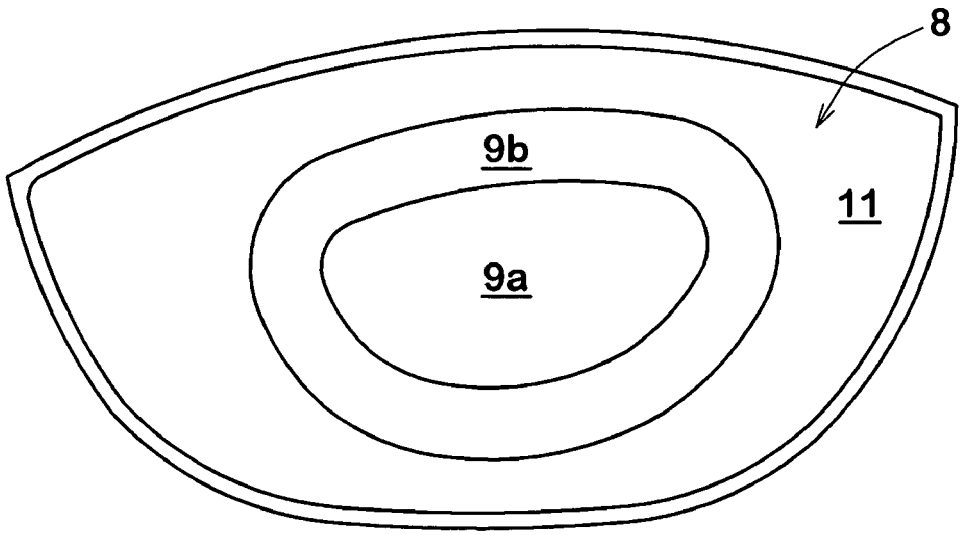

Ref. 1: As shown in FIG. 17, this example was a modification of Ex. 1 wherein all the radial protrusions were omitted.

Figure 18:
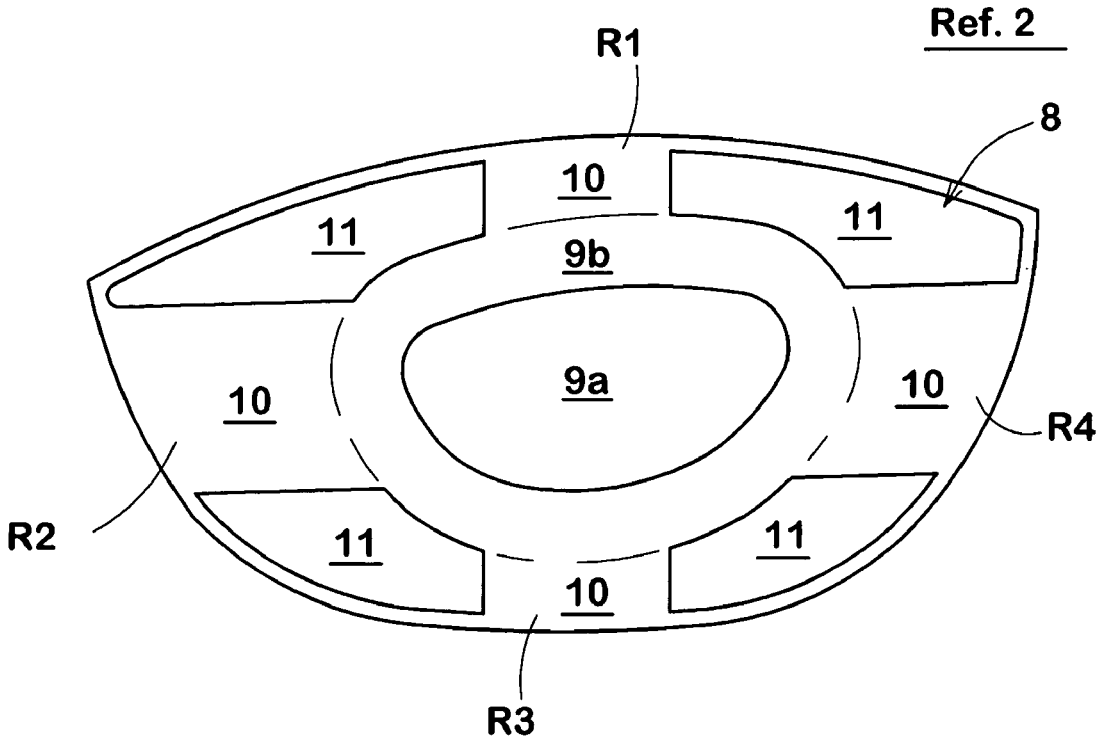
Figure 19:
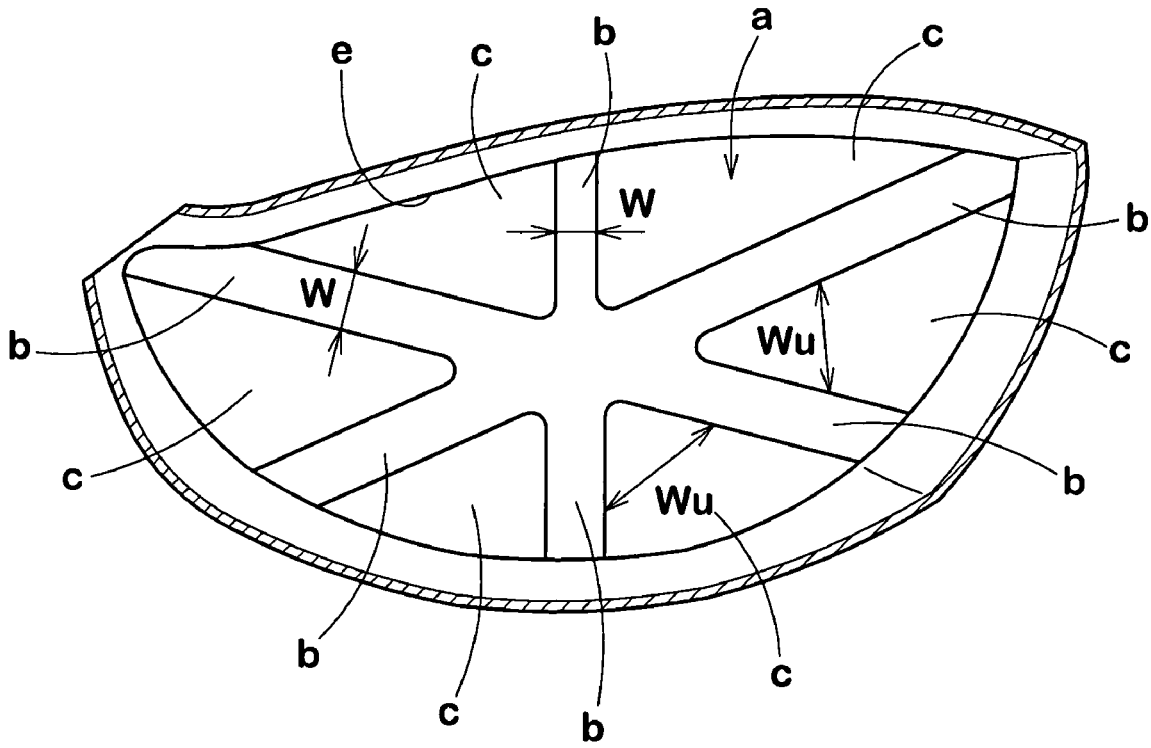
FIG.19 Prior Art
FIG. 19 is a rear view of the face portion of a Prior Art club head.

Ref. 2: As shown in FIG. 18, the rear face was provided with four constant-width radial protrusions.

In Table 1, the inside width Wi and outside width Wo of the radial protrusion are shown together with the width Wm measured at the midpoint. The width Wm is as shown in FIG. 13, measured at the middle point G of a straight line Y perpendicularly to the straight line Y which line is drawn between the middle point P5 of a straight line j1 and the middle point P6 of a straight line j2, wherein the straight line j1 is drawn between the radially outer ends P1 and P2 of the side edges 10*e*, and the straight line j2 is drawn between the radially inner ends P3 and P4 of the side edges 10*e*. The length L of the radial protrusion is as shown in FIG. 13, the length of the straight line Y.

Items [R1] to [R6] in Table 1 correspond to the radial protrusions R1 to R6 illustrated in the drawings.

Durability Test

Each club head was attached to a carbon shaft (manufactured by SRI sports Ltd.) to make a 45-inch wood, and the golf club was mounted on a swing robot. Then, the club head hit golf balls Max. 10000 times at the head speed of 54 meter/second, while checking the club head every 100 times. The results are shown in Table 1, wherein "A" means that no damage was found after the 10000-time hitting test, and numerical values mean the number of hitting times at which a damage was observed.

Restitution Coefficient Test

According to the "Procedure for Measuring the Velocity Ratio of a Club Head for Conformance to Rule 4-1e, Appendix II, Revision 2 (Feb. 8, 1999), United States Golf Association", the restitution coefficient (e) of each club head was obtained. In addition to the standard measuring position which is the sweet spot, the measurement was carried out at an upper position, lower position, toe-side position and heel-side position each located at a distance of 15 mm from the sweet spot.

The results are shown in Table 1. The larger the value, the better the rebound performance.

From the test results, it was confirmed that the durability can be remarkably improved without substantial decrease in the restitution coefficient. With respect to each hitting position, the decrease in the restitution coefficient from that of Ref. 1 could be restricted to under 3%.

As descried above, in the golf club head according to the present invention, owing to the variable-width radial protrusions, the thin part formed along the peripheral edge of the face portion can be decreased in the total length along the peripheral edge; therefore, the strength in the vicinity of the peripheral edge is increased to improve the durability of the face portion. On the other hand, as the widths of the variable-width radial protrusions become decreased near the center, deterioration of the rebound performance can be prevented.

TABLE 1

| | Ex. 1 | Ex. 2 | Ex. 3 | Ref. 1 | Ref. 2 | Ex. 4 |
|---|---|---|---|---|---|---|
| Club head | | | | | | |
| Peripheral protrusion | | | | | | |
| Width (mm) | 2-3 | 2-3 | 2-3 | 2-3 | 2-3 | 2-3 |
| Thickness te (mm) | 2.65 | 2.65 | 2.65 | 2.65 | 2.65 | 2.65 |
| Central protrusion | | | | | | |
| Main part | | | | | | |
| Thickness tc (mm) | 3.35 | 3.35 | 3.35 | 3.35 | 3.35 | 3.35 |
| Area S1 (×10^4 sq. mm) | 5.9 | 5.9 | 7.3 | 5.9 | 5.9 | 5.9 |
| Transitional part | | | | | | |
| Thickness (mm) | 3.35 to 2.65 | 3.35 to 2.65 | 3.35 to 2.65 | 3.35 to 2.65 | 3.35 to 2.65 | 3.35 to 2.65 |
| Area S2 (×10^4 sq. mm) | 10.0 | 10.0 | 12.4 | 10.0 | 10.0 | 10.0 |
| S1/S2 | 0.16 | 0.16 | 0.20 | 0.16 | 0.16 | 0.16 |
| (S1 + S2)/S | 0.44 | 0.44 | 0.54 | 0.44 | 0.44 | 0.44 |
| Radial protrusions | | | | | | |
| [R1] | | | | | | |
| Width Wi (mm) | 32.0 | 32.0 | 32.0 | — | 32.0 | 32.0 |
| Width Wm (mm) | 34.5 | 34.5 | 34.5 | — | 32.0 | 34.5 |
| Width Wo (mm) | 38.5 | 38.5 | 38.5 | — | 32.0 | 38.5 |
| Wo/Wi | 1.20 | 1.20 | 1.20 | — | 1.00 | 1.20 |
| Thickness tr (mm) | 2.65 | 2.65 | 2.65 | — | 2.65 | 2.65 |
| Length L (mm) | 6.5 | 6.5 | 4.9 | — | 6.5 | 6.5 |
| [R2] | | | | | | |
| Width Wi (mm) | 15.0 | 9.0 | 9.0 | — | 15.0 | 9.0 |
| Width Wm (mm) | 25.0 | 17.0 | 17.0 | — | 15.0 | 9.0 |
| Width Wo (mm) | 30.0 | 24.0 | 24.0 | — | 15.0 | 9.0 |
| Wo/Wi | 2.00 | 2.67 | 2.67 | — | 1.00 | 1.00 |
| Thickness tr (mm) | 2.65 | 2.65 | 2.65 | — | 2.65 | 2.65 |
| Length L (mm) | 15.0 | 20.0 | 15.2 | — | 15.0 | 20.0 |
| [R3] | | | | | | |
| Width Wi (mm) | 21.0 | 8.0 | 8.0 | — | 21.0 | 8.0 |
| Width Wm (mm) | 26.0 | 14.0 | 14.0 | — | 21.0 | 8.0 |
| Width Wo (mm) | 30.0 | 20.0 | 20.0 | — | 21.0 | 8.0 |
| Wo/Wi | 1.43 | 2.50 | 2.50 | — | 1.00 | 0.33 |
| Thickness tr (mm) | 2.65 | 2.65 | 2.65 | — | 2.65 | 2.65 |
| Length L (mm) | 7.5 | 11.5 | 8.74 | — | 7.5 | 11.5 |
| [R4] | | | | | | |
| Width Wi (mm) | 15.0 | 21.0 | 21.0 | — | 15.0 | 21.0 |
| Width Wm (mm) | 20.0 | 26.0 | 26.0 | — | 15.0 | 26.0 |
| Width Wo (mm) | 25.0 | 30.0 | 30.0 | — | 15.0 | 30.0 |
| Wo/Wi | 1.67 | 1.43 | 1.43 | — | 1.00 | 1.43 |
| Thickness tr (mm) | 2.65 | 2.65 | 2.65 | — | 2.65 | 2.65 |
| Length L (mm) | 12.0 | 7.5 | 5.7 | — | 12.0 | 7.5 |
| [R5] | | | | | | |
| Width Wi (mm) | — | 11.0 | 11.0 | — | — | 11.0 |
| Width Wm (mm) | — | 16.0 | 16.0 | — | — | 11.0 |
| Width Wo (mm) | — | 22.0 | 22.0 | — | — | 11.0 |
| Wo/Wi | — | 2.00 | 2.00 | — | — | 1.00 |
| Thickness tr (mm) | — | 2.65 | 2.65 | — | — | 2.65 |
| Length L (mm) | — | 12.0 | 9.1 | — | — | 12.0 |
| [R6] | | | | | | |
| Width Wi (mm) | — | 10.5 | 10.5 | — | — | 10.5 |
| Width Wm (mm) | — | 16.0 | 16.0 | — | — | 10.5 |
| Width Wo (mm) | — | 23.0 | 23.0 | — | — | 10.5 |
| Wo/Wi | — | 2.19 | 2.19 | — | — | 1.00 |
| Thickness tr (mm) | — | 2.65 | 2.65 | — | — | 2.65 |
| Length L (mm) | — | 10.0 | 7.6 | — | — | 10.0 |
| Reduced-thickness part | | | | | | |
| Thickness tp (mm) | 2.45 | 2.45 | 2.45 | 2.45 | 2.45 | 2.45 |
| tp/tc | 0.73 | 0.73 | 0.73 | 0.73 | 0.73 | 0.73 |
| tp/tr | 0.92 | 0.92 | 0.92 | — | 0.92 | 0.92 |
| Test Results | | | | | | |
| Durability | A | A | A | 3100 | 6300 | 9100 |
| Restitution coefficient | | | | | | |

TABLE 1-continued

| | Ex. 1 | Ex. 2 | Ex. 3 | Ref. 1 | Ref. 2 | Ex. 4 |
|---|---|---|---|---|---|---|
| Sweet spot | 0.825 | 0.825 | 0.820 | 0.829 | 0.826 | 0.825 |
| Upper | 0.791 | 0.791 | 0.786 | 0.801 | 0.792 | 0.791 |
| Lower | 0.753 | 0.752 | 0.751 | 0.763 | 0.753 | 0.752 |
| Toe-side | 0.770 | 0.772 | 0.767 | 0.781 | 0.771 | 0.772 |
| Heel-side | 0.793 | 0.794 | 0.788 | 0.803 | 0.793 | 0.794 |

The invention claimed is:

1. A hollow golf club head comprising a face portion having a front face defining a clubface and a rear face facing the hollow, the face portion being provided in the rear face with a central protrusion and a plurality of radial protrusions extending radially from the central protrusion towards a peripheral edge of the face portion, whereby, between the radial protrusions, resultant reduced-thickness parts extending radially from the central protrusion towards the peripheral edge of the face portion are formed, wherein the radial protrusions include at least one variable-width radial protrusion having a width increasing towards the peripheral edge from the central protrusion, the central protrusion comprises a main part having a substantially constant thickness of from 2.5 to 4.0 mm, and a thickness-transitional part surrounding the main part, the radial protrusions have a thickness less than the thickness of the main part, the reduced-thickness parts have a minimum thickness of 1.6 to 3.0 mm, and the thickness-transitional part has a thickness decreasing towards the peripheral edge so as to merge with the radial protrusions.

2. The hollow golf club head according to claim 1, wherein the minimum width of the variable-width radial protrusion occurs near or at the radial inner end thereof, and the ratio of the maximum width to the minimum width of the variable-width radial protrusion is in a range of 1.1 to 5.0.

3. The hollow golf club head according to claim 1, wherein at least one of the reduced-thickness parts which is adjacent to said at least one variable-width radial protrusion has a substantially constant width.

4. The hollow golf club head according to claim 1, wherein the increasing of the width of the variable-width radial protrusion is continuous.

5. The hollow golf club head according to claim 1, wherein said at least one variable-width radial protrusion includes two variable-width radial protrusions which extend towards a crown and a sole of the club head.

6. The hollow golf club head according to claim 5, wherein a vertical line passing through the sweet spot of the clubface is included within the widths of said two variable-width radial protrusions.

7. The hollow golf club head according to claim 1, wherein said at least one variable-width radial protrusion includes two variable-width radial protrusions which extend towards a toe and a heel of the club head.

* * * * *